United States Patent [19]

Newman

[11] Patent Number: 4,734,029

[45] Date of Patent: Mar. 29, 1988

[54] BURNER FOR CAMPSTOVE

[75] Inventor: Duncan Newman, Toronto, Canada

[73] Assignee: The Coleman Company, Inc., Wichita, Kans.

[21] Appl. No.: 887,443

[22] Filed: Jul. 21, 1986

[51] Int. Cl.[4] ..... F23D 11/44

[52] U.S. Cl. ..... 431/211; 431/222; 126/44; 239/555

[58] Field of Search ..... 431/211, 218, 222, 225; 126/44; 239/555, 567

[56] References Cited

U.S. PATENT DOCUMENTS

| | | | |
|---|---|---|---|
| 318,303 | 5/1885 | Schneider et al. | 431/225 |
| 1,299,935 | 4/1919 | Harris | 431/218 |
| 2,246,080 | 6/1941 | Tullis | 126/44 |
| 2,326,221 | 8/1943 | Hill | 431/222 |
| 2,491,430 | 7/1946 | Tullis | 126/44 |

FOREIGN PATENT DOCUMENTS 660993 2/1929 France .

*Primary Examiner*—Carroll B. Dority, Jr.

[57] ABSTRACT

A campstove burner includes a burner box which is located above the burner pan of the burner. The burner rings are positioned between the burner pan and the burner box, and a fuel and air mixture within the burner box flows through the burner rings where it is ignited. Since the burner box is located above the burner pan, liquid fuel within the burner box will flow through the burner rings and will be ignited in the burner pan outside of the burner box. The burner box includes an L-shaped aspirator tube for mixing fuel and air. An inlet end of the aspirator tube communicates with a source of primary combustion air, and a fuel tube extends into the outlet end of the aspirator tube for aspirating combustion air into the inlet end. The burner box includes a generally cylindrical sidewall and the outlet end of the aspirator tube directs the fuel and air mixture generally tangentially to the inside of the cylindrical sidewall to promote swirling and mixing of the fuel and air.

16 Claims, 5 Drawing Figures

FIG. 3
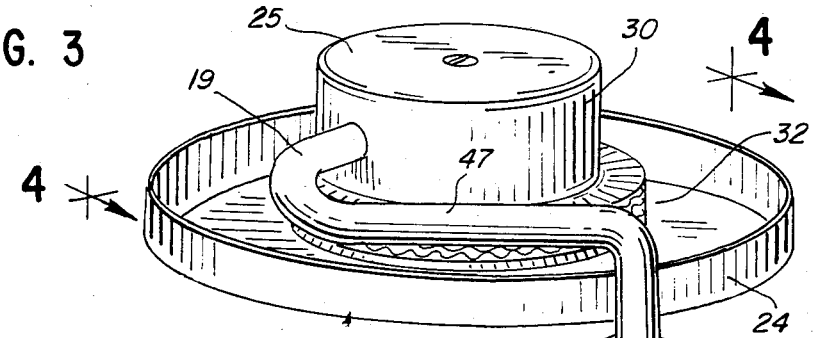
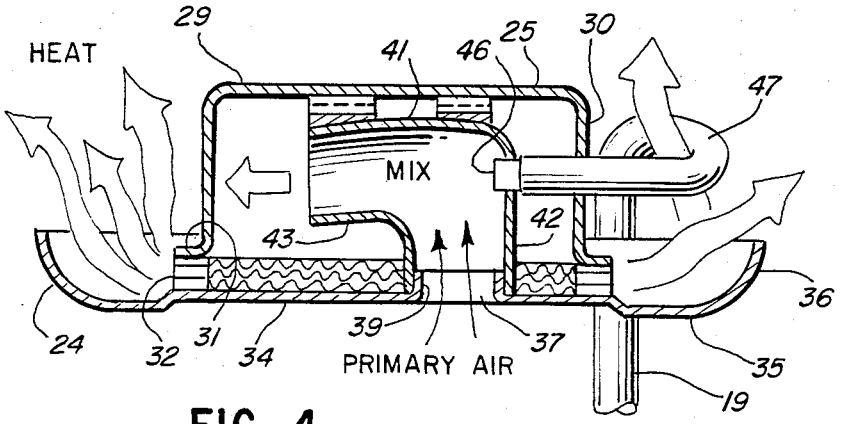
FIG. 4
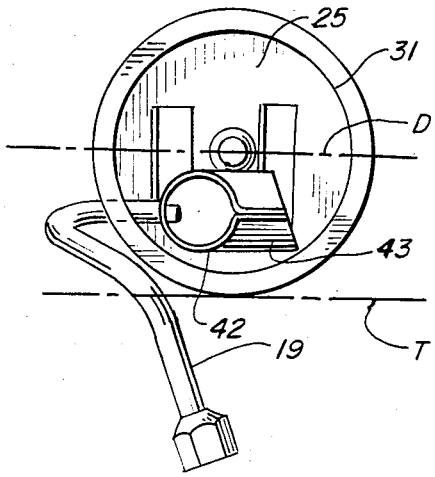
FIG. 5

BURNER FOR CAMPSTOVE

BACKGROUND

This invention relates to campstoves, and, more particularly, to improved burner assemblies for campstoves.

Campstoves which use liquid fuel typically include a burner assembly in which a burner box for mixing fuel and air is located below the burner. A generator tube delivers vaporized fuel to the burner, and a fuel and air mixture flows upwardly from the burner box to the burner where it is ignited. U.S. Pat. No. 4,126,117 (reissued as U.S. Pat. Re. No. 31,738) describes this type of campstove.

U.S. Pat. No. 3,933,146 describes a campstove which uses propane fuel. This campstove also includes a burner box which is positioned below the burner.

In conventional liquid fuel burner assemblies in which the burner box is positioned below the burner, any fuel which is ejected from the generator tube in a liquid state collects in the bottom of the burner box away from the burner. The possibility of liquid fuel collecting in the burner box is even greater in cold temperatures. A substantial period of time can elapse before this liquid fuel is vaporized and reaches the burner, and the efficiency of the burner assembly is thereby reduced.

Flooding of the burner box with liquid fuel also interferes with the start-up of the burner assembly. Campstoves are commonly provided with an instant-light fuel supply mechanism which supplies a fuel-air mixture to the generator tube so that the burner can be ignited before the generator tube is heated sufficiently to vaporize the fuel in the generator tube. After the burner is ignited and heats the generator tube sufficiently to vaporize the fuel in the generator tube, the instant-light mechanism is turned off and only fuel flows through the generator tube. Liquid fuel which collects in the burner box during start-up is not available for combustion at the burner, and more time is required to heat the generator before the instant-light mechanism can be turned off. Since the burner burns less efficiently during start-up and emits less heat, a short start-up time is desirable.

Conventional burner assemblies also include means for mixing fuel and air and delivering the fuel-air mixture to the burner for combustion. It is important that the fuel and air are mixed thoroughly before ignition to provide a properly carbureted fuel mix for optimum efficiency, i.e., the smallest amount of fuel for a given BTU output.

SUMMARY OF INVENTION

The invention provides a burner box which is located above the burner of a campstove. Any liquid fuel which is ejected from the generator tube can therefore flow out of the burner box to the burner for combustion along with the properly mixed fuel-air mixture. Since all of the fuel which flows from the generator tube is combusted, greater heat is available during start-up, and the start-up period is substantially decreased, particularly during cold weather. The burner box includes an improved aspirator tube for mixing fuel and air in the burner box. An L-shaped apsirator tube includes an inlet end which communicates with a source of combustion air. The outlet end of the aspirator tube is offset from the diameter of a cylindrical burner box and extends generally parallel to a tangent to the cylindrical sidewall of the burner box. The generator tube extends into the aspirator tube in alignment with the outlet end. Fuel ejected from the generator tube aspirates combustion air into the inlet end of the aspirator tube, and the fuel and air are mixed in the outlet end before the mixture flows into the burner box. The mixture is directed by the outlet end to swirl around the cylindrical wall of the burner box, causing further mixing of the fuel and air before the mixture reaches the burner. Any liquid fuel which flows into the annular mixing chamber during start-up falls downwardly to the burner pan and flows through the burner pan for combustion along with the properly mixed fuel-air mixture.

DESCRIPTION OF THE DRAWING

The invention will be explained in conjunction with an illustrative embodiment shown in the accompanying drawing in which

FIG. 3 is a fragmentary perspective view of a portion of the burner assembly of FIG. 1;

FIG. 4 is a fragmentary perspective view taken along the line 4—4 of FIG. 3; and FIG. 5 is a bottom plan view of the burner box of FIGS. 3 and 4.

DESCRIPTION OF SPECIFIC EMBODIMENT

Figure 1:
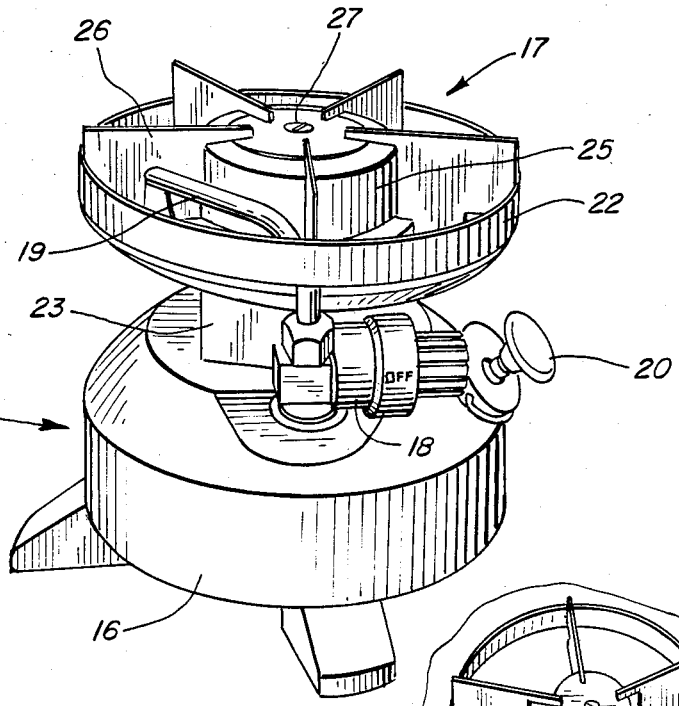
FIG. 1 illustrates a campstove equipped with a burner assembly in accordance with the invention.

FIG. 1 illustrates a campstove 15 which includes a conventional fuel tank 16 and a burner assembly 17 which is mounted on the fuel tank. A fuel control valve 18 supplies fuel from the tank to a generator tube 19, and the generator tube supplies fuel to the burner assembly. The particular campstove illustrated is a liquid fuel campstove and includes an air pump 20 for pressurizing the air above the liquid fuel in the tank. It will be understood, however, that the invention can also be used with other types of campstoves, e.g., propane and butane campstoves.

Figure 2:
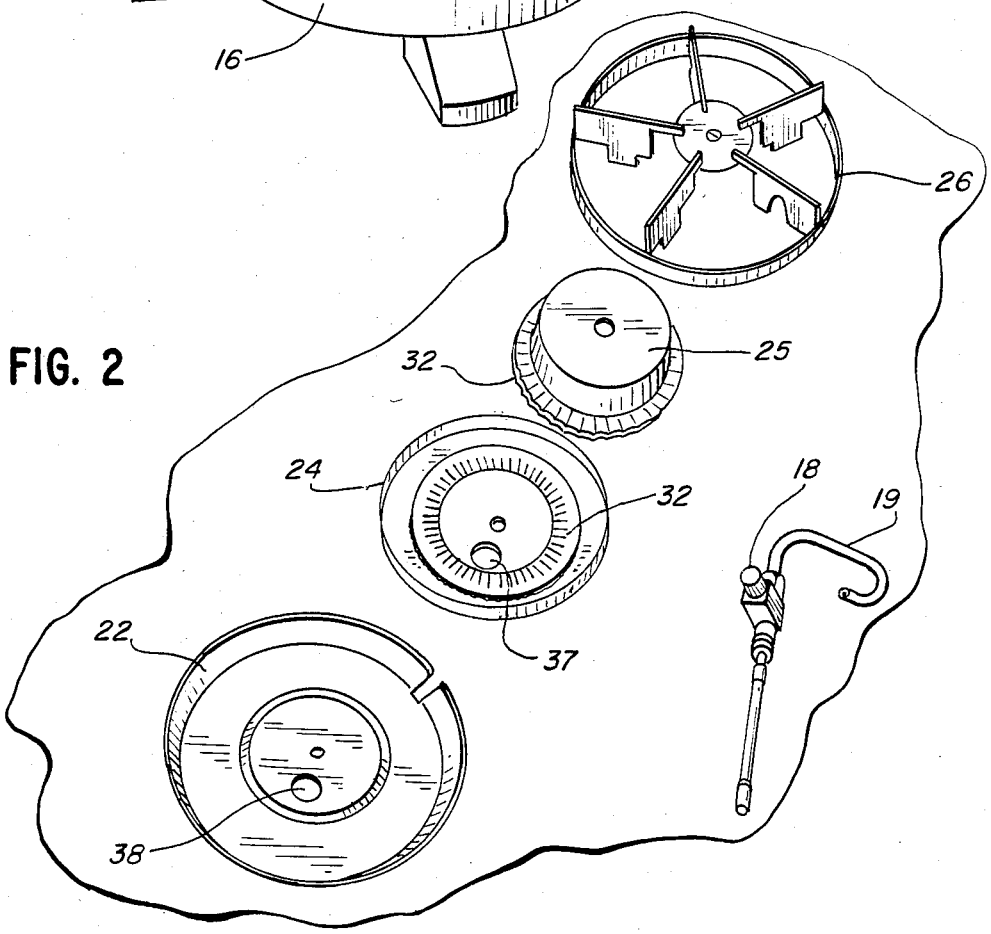
FIG. 2 is a partially exploded view of the burner assembly of FIG. 1.

Referring to FIG. 2, the burner assembly 17 includes a reflector bowl 22 which is supported by a mounting bracket 23 (FIG. 1) on the fuel tank. A burner pan 24 is supported generally concentrically on the reflector bowl, and a generally cup-shaped burner box or cap 25 is mounted on the burner pan. A grate 26 is supported by the burner box and the burner pan and the entire assembly is held together and attached to the mounting bracket 23 by a screw 27 (FIG. 1).

The burner box includes a top wall 29 (FIG. 4), a cylindrical sidewall 30, and an outwardly extending bottom flange 31. A plurality of corrugated burner rings 32 are positioned between the bottom flange 31 and the burner pan 24. The burner rings 32 are well known and are available from The Coleman Company, Inc., of Wichita, Kans., under the name "Band-A-Blu". Additional details of the burner rings are described in U.S. Pat. No. 3,933,146. As will be described more fully hereinafter, the corrugated burner rings provide a porous support for the burner box which enables fuel and air to flow outwardly from the burner box 25.

The burner pan 24 includes a flat central portion 34 which supports the burner rings 32, annular portion 35 which provides a fuel-collecting trough below the central portion, and an outer rim 36. An air opening 37 (FIGS. 2 and 4) is provided through the central portion of the burner pan offset from the center thereof and is aligned with an opening 38 (see FIG. 1) in the reflector bowl 22. An upwardly extending extrusion or collar 39 (FIG. 4) surrounds the opening 37 in the burner pan.

An L-shaped aspirator tube or elbow 41 (FIGS. 4 and 5) is attached to the top wall 29 of the burner box 25. The aspirator includes an air inlet end portion 42 which surrounds the collar 39 and extends upwardly therefrom and an outlet end portion 43. Referring to FIG. 5, the outlet end 43 is offset from a diameter D of the burner box and extends parallel to the diameter D and to a tangent T to the cylinder bowl sidewall of the burner box. The end edge 44 of the outlet end portion forms an acute angle with the longitudinal axis of the outlet end portion.

The generator tube 19 extends from the fuel control valve 18 through an opening in the cylindrical side wall 30 of the burner box 25 and into the aspirator tube 41. The end of the generator tube includes a conventional nozzle 46 having a gas jet or orifice, and the nozzle directs fuel to flow in a direction which is parallel to the longitudinal axis of the outlet portion 43 of the aspirator tube. The generator tube 19 is shaped so that an intermediate portion 47 thereof (FIGS. 3 and 4) extends over the burner pan 24 above the burner rings 32.

The campstove 15 includes a conventional instant-light mechanism for facilitating start-up of the burner. Such instant-light mechanisms are well known in the art and need not be described herein. When the instant-light mechanism is on, air in the fuel tank is entrained with liquid fuel, and a fuel-air mixture is ejected from the nozzle 46 at the end of the generator tube 19. The flow of the fuel-air mixture into the aspirator tube 41 aspirates ambient air into the inlet end of the aspirator tube and additional air is mixed with the fuel. The fuel-air mixture flows out of the aspirator tube generally tangentially to the cylindrical sidewall of the burner box 25, and additional mixing occurs as the mixture swirls around the inside of the burner box. The fuel-air mixture eventually flows through the burner rings 32 where it is ignited. Heat from the burning fuel heats the generator tube 19, particularly the intermediate portion 47 which extends over the burner pan 24, and the generator tube eventually becomes hot enough to vaporize the fuel passing there-through. The instant-light mechanism can then be turned off. Vaporized fuel is ejected from the nozzle into the aspirator tube, and primary combustion air is aspirated into the inlet end of the aspirator and mixed with the fuel in the outlet end of the aspirator. Additional mixing occurs as the fuel and air swirl around the burner box.

The inside surface of the aspirator tube 41 is smooth, and the elbow of the aspirator tube is smoothly curved to minimize flow resistance. The aspirator tube acts as a one-way valve to ensure that the mixing chamber within the burner box 25 is pressurized with the correct fuel-air mixture for proper combustion. The off-center position of the outlet end of the aspirator tube increases the length of the flow path within the burner box before the fuel-air mixture flows through the burner rings and provides increased mixing. The angled end edge of the aspirator tube facilitates the flow of the fuel-air mixture between the aspirator and the cylindrical sidewall 30.

Because the burner box 25 is located above the burner rings, any liquid fuel which exits the generator tube and falls to the central portion 34 of the burner pan 24 flows through the burner rings. The liquid fuel is either ignited at the outside of the burner rings or collects in the trough 35 of the burner pan where it ignites. Since even the liquid fuel which falls to the bottom of the burner box is ignited, all of the fuel is available for heating the generator tube, and the instantlight mechanism can be turned off relatively quickly. The collar 39 around the air opening 37 in the burner pan prevents liquid fuel from falling through the opening. The hole for the hold-down screw 27 (FIG. 1) has a similar collar.

The aspirator tube 41 could also be used in a burner box which was positioned in the conventional location below the burner rings. The aspirator tube would still provide increased mixing of fuel and air before the fuel-air mixture flows upwardly through the burner rings.

While in the foregoing specification detailed descriptions of specific embodiments of the invention were set forth for the purpose of illustration, it will be understood that many of the details herein given may vary considerably by those skilled in the art without departing from the spirit and scope of the invention.

I claim:

1. A burner assembly for a campstove comprising a burner pan, a plurality of burner rings mounted on the pan for permitting fuel and air to flow therethrough, a burner box mounted on said burner rings and providing a fuel and air mixing chamber above said burner rings, an aspirator tube extending upwardly from an opening in the burner pan into the mixing chamber, and a fuel tube which extends into said aspirator tube for permitting fuel and air to enter said mixing chamber whereby a fuel and air mixture within the mixing chamber can flow through said burner rings and liquid fuel within the mixing chamber can flow by gravity through the burner rings and be collected by the burner pan.

2. The burner assembly of claim 1 in which said aspirator tube is generally L-shaped and includes an upwardly extending inlet portion which extends from the opening in the burner pan and an outwardly extending outlet portion.

3. The burner assembly of claim 2 in which the burner box includes a generally cylindrical sidewall, the outwardly extending outlet portion of the aspirator tube being offset from the diameter of the cylindrical sidewall and directing fuel and air in a direction which is generally parallel to a tangent to the cylindrical sidewall whereby fuel and air are caused to swirl around the inside of the cylindrical sidewall.

4. The burner assembly of claim 2 in which the fuel tube extends into the outwardly extending outlet portion of said aspirator tube in a direction which is generally parallel to the outlet portion.

5. The burner assembly of claim 2 in which the outwardly extending outlet portion of the aspirator tube is tubular and terminates in a plane which forms an acute angle with the axis of the outlet portion.

6. The burner assembly of claim 1 in which the burner pan includes an upwardly extending collar which surrounds the opening in the burner pan and prevents liquid fuel from falling through the opening.

7. The burner assembly of claim 6 in which the aspirator tube surrounds the upwardly extending collar of the burner pan.

8. The burner assembly of claim 1 in which the fuel tube extends over the burner pan outwardly of said burner rings whereby the fuel tube is heated by fuel which burns outside of said porous means.

9. The burner assembly of claim 8 in which the burner box is generally cylindrical and a portion of the fuel tube extends generally arcuately around the burner box.

10. The burner assembly of claim 1 in which said burner pan includes a central portion which supports said burner rings, an outer portion outwardly of said burner rings which is positioned below said central portion for forming a trough for collecting liquid fuel, and an outer rim which extends upwardly from the outer portion.

11. A campstove comprising a fuel tank, a burner pan mounted above the fuel tank, a burner box above the burner pan, burner box support means between the burner pan and the burner box for supporting the burner box, the burner box support means having passages for permitting fuel and air to flow therethrough, the burner box providing a fuel and air mixing chamber above said passages, means for permitting fuel and air to enter said mixing chamber whereby a fuel and air mixture within the mixing chamber can flow through the passages of the burner box support means and liquid fuel within the mixing chamber can flow by gravity through the passages in the burner box support means and be collected by the burner pan, and a grate mounted above the burner box.

12. The structure of claim 11 in which said means for permitting air to enter said mixing chamber comprises an L-shaped aspirator tube which includes an upwardly extending inlet portion which extends upwardly from an opening in the burner pan and an outwardly extending outlet portion and said means for permitting fuel to enter said mixing chamber comprises a fuel tube which communicates with the aspirator tube.

13. The structure of claim 12 in which the burner box includes a generally cylindrical side wall, the outwardly extending outlet portion of the aspirator tube being offset from the diameter of the cylindrical side wall and directing fuel and air in a direction which is generally parallel to a tangent to the cylindrical side wall whereby fuel and air are caused to swirl around the inside of the cylindrical side wall.

14. A burner assembly for a campstove burner comprising a top wall, a bottom wall, and a cylindrical side wall between the top and bottom walls, said walls forming a chamber for mixing fuel and air, a generally L-shaped aspirator tube in the chamber, the L-shaped aspirator tube including an upwardly extending inlet portion which extends upwardly from an opening in the bottom wall and an outwardly extending outlet portion, a fuel tube extending into the aspirator tube for delivering fuel to the aspirator tube, said outwardly extending outlet portion of said aspirator tube being offset from the diameter of said cylindrical side wall and extending generally parallel to a tangent to said cylindrical side wall whereby fuel and air are caused to swirl around the inside of said cylindrical side wall, and means for allowing fuel and air to exit from the chamber.

15. The burner assembly of claim 14 in which the fuel tube extends into the outwardly extending portion of the aspirator tube generally parallel to the axis thereof.

16. The burner assembly of claim 14 in which the outwardly extending outlet portion of the aspirator tube is tubular and terminates in a plane which forms an acute angle with the axis of the outlet portion.

* * * * *